US011746311B2

(12) United States Patent
Al-Bayati et al.

(10) Patent No.: US 11,746,311 B2
(45) Date of Patent: Sep. 5, 2023

(54) GRANULATE FOR DETERGENT COMPOSITION COMPRISING NITROGEN-CONTAINING BUILDERS

(71) Applicant: Reckitt Benckiser Finish B.V., Hoofddorp (NL)

(72) Inventors: Alias Younis Al-Bayati, Heidelberg (DE); Torsten Roth, Heidelberg (DE); Claudia Schmaelzle, Heidelberg (DE); Andrea Stein, Heidelberg (DE)

(73) Assignee: Reckitt Benckiser Finish B.V., Hoofddorp (NL)

( * ) Notice: Subject to any disclaimer, the term of this patent is extended or adjusted under 35 U.S.C. 154(b) by 176 days.

(21) Appl. No.: 17/274,318

(22) PCT Filed: Sep. 9, 2019

(86) PCT No.: PCT/EP2019/073963

§ 371 (c)(1),
(2) Date: Mar. 8, 2021

(87) PCT Pub. No.: WO2020/053132

PCT Pub. Date: Mar. 19, 2020

(65) Prior Publication Data

US 2021/0340470 A1 Nov. 4, 2021

(30) Foreign Application Priority Data

Sep. 14, 2018 (GB) ..... 1814981

(51) Int. Cl.

| | |
|---|---|
| ***C11D 17/00*** | (2006.01) |
| ***C11D 17/04*** | (2006.01) |
| ***C11D 3/33*** | (2006.01) |
| ***C11D 3/37*** | (2006.01) |

(52) U.S. Cl.

CPC ..... *C11D 17/0039* (2013.01); *C11D 3/33* (2013.01); *C11D 17/044* (2013.01)

(58) Field of Classification Search

None

See application file for complete search history.

(56) References Cited

U.S. PATENT DOCUMENTS

| | | | |
|---|---|---|---|
| 6,605,304 | B1 | 8/2003 | Wellinghoff et al. |
| 9,096,820 | B2 | 8/2015 | Van Lare et al. |
| 2008/0045430 | A1 | 2/2008 | Witteler et al. |
| 2008/0300159 | A1 | 12/2008 | Seebeck et al. |
| 2021/0024857 | A1 | 1/2021 | Simonsen et al. |

FOREIGN PATENT DOCUMENTS

| | | | | |
|---|---|---|---|---|
| CN | 102666828 | A1 | | 9/2012 |
| CN | 105352904 | A | * | 2/2016 |
| CN | 107475235 | A | | 12/2017 |
| DE | 102004032320 | A1 | | 1/2006 |
| EP | 1803801 | A1 | | 7/2007 |
| EP | 1918360 | A1 | | 5/2008 |
| EP | 3266860 | A1 | | 1/2018 |
| GB | 2415695 | A | | 1/2006 |
| WO | 03/020867 | A1 | | 3/2003 |
| WO | 2014/037255 | A1 | | 3/2014 |
| WO | 2015121170 | A1 | | 8/2015 |
| WO | 2017/153528 | A1 | | 9/2017 |

OTHER PUBLICATIONS

International Search Report and Written Opinion dated Apr. 12, 2019, issued in corresponding PCT International Application No. PCT/EP2019/073963.

Chinese Search Report dated Mar. 9, 2022.

* cited by examiner

*Primary Examiner* — Lorna M Douyon

(74) *Attorney, Agent, or Firm* — Troutman Pepper Hamilton Sanders LLP; Ryan A. Schneider; Chris N. Davis

(57) ABSTRACT

A granulate for a detergent composition, the granulate comprising a nitrogen-containing builder, wherein the granulate is at least partially coated with a coating material comprising an alkoxy polyalkylene glycol.

17 Claims, No Drawings

GRANULATE FOR DETERGENT COMPOSITION COMPRISING NITROGEN-CONTAINING BUILDERS

CROSS-REFERENCE TO RELATED APPLICATIONS

This application is a national stage entry of, and claims priority to, PCT Application No. PCT/EP2019/073963, filed on 9 Sep. 2019, which claims the benefit of GB Application No. 1814981.5, filed on 14 Sep. 2018, the disclosures of each of which are herein incorporated by reference in their entirety.

The present disclosure relates to a granulate for a detergent composition. In particular, the present disclosure relates to a granulate comprising a nitrogen-containing builder exhibiting improved stability compared with existing granulates including nitrogen-containing builders.

Household detergents are widely used in many applications including laundry care and for hard-surface cleaning such as in an automatic dishwasher. The detergents are commonly available in many product formats including liquids, powders and solids.

It is recognised that a common household detergent is usually made up of a number of different components. One component that is typically present in a laundry/automatic dishwasher detergent is a builder. The builder is used as a chelating agent to aid the removal/capture of metal ions in solution. With their use, deposits of metal ion based sediments (such as limescale) within automatic washing machines are reduced and the cleaning process is enhanced (certain stains incorporate a metal ion component, such as tea stains which comprise complex mixtures of calcium and/or magnesium ions together with potentially oxidized and crosslinked polyphenolic compounds).

In the past and up until recently, builders based upon phosphate have been widely used. These have the advantage of being inexpensive, compatible with other detergent components (both in solid and liquid detergent formulations) and washing machines, and are widely available. However, one problem with the use of phosphate based builders is that of environmental pollution: excess phosphates in water courses are connected with detrimental environmental effects such as eutrification and excess algal growth, leading to other issues such as a reduction in fish populations. Consequently the use of phosphates has been legislated against in many jurisdictions, and there is a need for alternative builders/chelating agents.

One possible alternative is to use a salt of a polyfunctional carboxylic acid such as citrate. However, whilst salts such as citrate are more environmentally acceptable, the activity of citrate as a builder is not as high as that of phosphate. This is particularly noticeable at higher washing temperatures, such as those experienced in an automatic dishwasher (>50° C.).

Nitrogen-containing builders such as those based on aminocarboxylates, including methylglycine diacetate (MGDA) and N,N-dicarboxymethyl glutamate (GLDA), are now commonly used. However, while aminocarboxylate builders in particular are excellent chelating agents, certain nitrogen-containing builders (and especially MGDA) are known to exhibit a distinct yellow discolouration under oxidising conditions (e.g. in the presence of a bleaching agent), particularly at elevated temperatures and moisture levels. This yellowing is aesthetically unappealing to the consumer.

A number of approaches have been developed for dealing with the discolouration issue. For example, EP 3105309 A1 describes powders or granules of aminocarboxylates coated with homo- or co-polymers of partially or fully neutralized (meth)acrylic acid, which display limited yellowing in the presence of inorganic peroxides. However, existing approaches tend to deteriorate the activity of the bleaching agent and/or considerably slow down the dissolution of the builder in use.

Other approaches aim to sidestep the discolouration issue by masking the discolouration in the detergent product. For example, some commercially available multi-chamber pouches effectively block the consumer from seeing the aminocarboxylate-containing powder compartment by including surfactant compartments on the top of the pouch and a white background printed onto the bottom of the pouch. Other products on the market include dyes to aid in masking the discolouration. However, these approaches lack versatility in the sense that they cannot be applied to a wide range of detergent compositions or product formats. Moreover, many dyes and colourants are known to deteriorate in the presence of oxidising agents, particularly under harsh conditions (such as high moisture levels and elevated temperatures).

Accordingly, it is one object of the present invention to provide an improved and/or alternative means for reducing the yellowing of a nitrogen-containing builder in a detergent composition in the presence of bleaching agents.

It is an alternative and/or additional object to provide a means for reducing the yellowing of a nitrogen-containing builder in a detergent composition that does not deteriorate the activity of the bleaching agent and/or considerably slow down the dissolution of the builder in a cleaning operation.

According to a first aspect, the present invention provides a granulate for a detergent composition, the granulate comprising a nitrogen-containing builder, wherein the granulate is at least partially coated with a coating material comprising an alkoxy polyalkylene glycol.

The present inventors have found that a granulate comprising a nitrogen-containing builder displays a significantly higher stability in the presence of oxidising species, elevated moisture levels and high temperatures if the granulate is at least partially coated with a coating material comprising an alkoxy polyalkylene glycol. This increase in stability has been corroborated by extended stability trials which included storage of thermoformed polyvinyl alcohol (PVOH) pouches in climate chambers under harsh conditions. In particular, applying alkoxy polyalkylene glycols to the granulates resulted in less yellowing of the nitrogen-containing material and thus a visually more appealing product.

According to a second aspect, the present invention provides a method of preparing a granulate for a detergent composition, the method comprising:

(i) providing particles comprising a nitrogen-containing builder; and (ii) at least partially coating the particles with a coating material comprising an alkoxy polyalkylene glycol.

According to a third aspect, the present invention provides a granulate obtainable or obtained by the method of the second aspect.

According to a fourth aspect, the present invention provides a detergent composition comprising the granulate of the first or third aspects.

According to a fifth aspect, the present invention provides a detergent product comprising the composition of the fourth aspect.

According to a sixth aspect, the present invention provides the use of the detergent composition of the fourth aspect or the detergent product of the fifth aspect in an automatic dishwashing process or a laundry process.

According to a seventh aspect, the present invention provides the use of a coating material comprising an alkoxy polyalkylene glycol to reduce the yellowing of a nitrogen-containing builder in a detergent composition.

The present invention will now be described further. In the following passages different aspects/embodiments of the invention are defined in more detail. Each aspect/embodiment so defined may be combined with any other aspect/embodiment or aspects/embodiments unless clearly indicated to the contrary. In particular, any feature indicated as being preferred or advantageous may be combined with any other feature or features indicated as being preferred or advantageous.

The present invention provides a granulate for a detergent composition. In other words, the granulate is suitable for use in a detergent composition. The term "granulate" as used herein refers to a plurality of granules, i.e. solid agglomerates of powder particles.

The granulate comprises a nitrogen-containing builder, preferably in an amount of at least 40 wt %, more preferably at least 50 wt %, still more preferably from 70 to 90 wt % by weight of the granulate. Preferably, the granulate comprises the nitrogen-containing builder and one or more further components.

The term "builder", as used herein, refers to compounds which, in use, perform a chelating function, for example the capture or removal of metal ions in a cleaning process. The term "nitrogen-containing builder", as used herein, refers to builder compounds containing nitrogen atoms and encompasses salts, esters and other derivatives thereof. Preferably, the nitrogen-containing builder is or comprises an aminocarboxylate. The term "aminocarboxylate" encompasses the free acid as well as salts, esters and derivatives thereof.

Preferably, the aminocarboxylate is selected from the group consisting of aspartate-N-monoacetate (ASMA), aspartate-N,N-diacetate (ASDA), aspartate-N-monopropionate (ASMP), iminodisuccinate (IDA), N-(2-sulfomethyl) aspartate (SMAS), N-(2-sulfoethyl)aspartate (SEAS), N-(2-sulfomethyl)glutamate (SMGL), N-(2-sulfoethyl)glutamate (SEGL), N-methyliminodiacetate (MIDA), α-alanine-N,N-diacetate (α-ALDA), β-alanine-N,N-diacetate (β-ALDA), serine-N,N-diacetate (SEDA), isoserine-N,N-diacetate (ISDA), phenylalanine-N,N-diacetate (PHDA), anthranilicate-N,N-diacetate (ANDA), sulfanilicate-N,N-diaceticate (SLDA), taurine-N,N-diacetate (TUDA), sulfomethyl-N,N-diacetate (SMDA) and combinations of two or more thereof. Again, in each instance the free acids as well as salts, esters and derivatives thereof are encompassed by the foregoing terms.

More preferably, the aminocarboxylate builder is selected from the group consisting of methylglycine diacetate (MGDA), N,N-dicarboxymethyl glutamate (GLDA), an iminodisuccinate, and a combination thereof. Most preferably, the aminocarboxylate builder is or comprises MGDA. MGDA is particularly susceptible to discolouration in the presence of oxidising agents.

In some embodiments, the granulate further comprises a silicate, preferably an alkali metal disilicate such as sodium disilicate. The granulate may further comprise water. In an especially preferred embodiment, the granulate comprises, by weight of the granulate, from 50 to 90 wt % of the nitrogen-containing builder, from 1 to 30 wt % of the silicate and less than 15 wt % of water. Nitrogen-containing builder granulates that include silicate are more storage stable than unmodified nitrogen-containing builder granulates or powders when included in a detergent composition. Without wishing to be bound by theory, it is believed that this could be due to a "dilution" effect of the nitrogen-containing builder in the granulate that decreases the yellow overall appearance, as well as the silicate stabilizing any peroxidic species and preventing unwanted side reactions. Suitable granulates are described in WO 2014/027181 A1, the contents of which are incorporated herein by reference.

The granulate of the present invention may further comprise one or more non-nitrogen based builders. For example, the granulate may further comprise a co-builder selected from the group consisting of homopolymers and copolymers of polycarboxylic acids and their partially or completely neutralized salts, monomeric polycarboxylic acids and hydroxycarboxylic acids and their salts, phosphates and phosphonates, and combinations of such substances. Preferred salts of the abovementioned compounds are the ammonium and/or alkali metal salts, i.e. the lithium, sodium, and potassium salts, and particularly preferred salts is the sodium salts. Co-builders which are organic are preferred. An example of a polymeric polycarboxylic acid is the homopolymer of acrylic acid. Other suitable co-builders are disclosed in WO 95/01416, which is incorporated herein by reference. Most preferably, the co-builder is trisodium citrate and/or hydroxyethylidene diphosphonate (HEDP).

Alternatively or in addition, the granulate may further comprise one or more ingredients that are conventionally included in detergent compositions. For example, the detergent composition may include one or more of the following: corrosion inhibitors, fragrances, surfactants, binding agents, acidity modifying agents, dispersion aids, enzymes and preservatives. Such ingredients are well-known to those skilled in the art.

Preferably, the granulate is crystalline. Crystallinity further improves the storage stability of the granulate when included in a detergent composition. Without wishing to be bound by theory, it is believed that this is due to the ability of a crystalline solid to comprise water of crystallization. Thus, a crystalline solid is typically less hygroscopic and more storage stable than an amorphous solid.

The granulate of the present invention is at least partially coated with a coating material comprising an alkoxy polyalkylene glycol. Preferably, the alkoxy polyalkylene glycol is present in an amount of at least 90 wt % by weight of the coating material. Preferably, the coating material consists essentially of or consists of the alkoxy polyalkylene glycol.

The alkoxy polyalkylene glycol coating is effective in reducing the yellow discolouration that is known to occur for certain nitrogen-containing builders such as aminocarboxylates and their by-products in the presence of oxidising species, particularly at elevated moisture levels and high temperatures. This granulate can therefore be included in a detergent composition that is more visually appealing to the consumer, and advantageously does not deteriorate the activity of any bleaching agent present or considerably slow down the dissolution of the nitrogen-containing builder in a cleaning operation. Polyalkylene glycols have previously been used for transferring dyes to aminocarboxylate granulates and have a low viscosity, which facilitates the coating of the granulates. However, the present inventors have found that polyalkylene glycols that are not end-capped with an alkoxy group do not reduce the yellowing of the nitrogen-containing builder granulates in storage. Without wishing to be bound by theory, it is believed that the increased hydrophobicity of an alkoxy polyalkylene glycol relative to a polyalkylene glycol contributes to its stabilising effect by providing a barrier for polar oxidising species.

The term "alkoxy polyalkylene glycol" as used herein refers to a polyalkylene glycol that is end-capped with an alkoxy group. The alkoxy polyalkylene glycol may be end-capped at one end or both ends. Preferably, the alkoxy polyalkylene glycol has a weight average molecular weight of from 200 to 500 g/mol, more preferably from 300 to 400 g/mol. Preferably, the alkoxy polyalkylene glycol and/or the coating material is a liquid at 25° C. This facilitates the coating of the granulate and ensures that, in a cleaning operation, the dissolution of the nitrogen-containing builder is not impeded by the presence of the coating. Preferably, the alkoxy polyalkylene glycol and/or the coating material is a liquid at 25° C. and $10^5$ Pa.

Preferably, the alkoxy group of the alkoxypolyalkylene glycol is represented by the formula RO wherein R is a $C_1$ to $C_{20}$ alkyl group, more preferably $C_1$ to $C_{10}$. More preferably, the alkoxy polyalkylene glycol is selected from a methoxy polyalkylene glycol, an ethoxy polyalkylene glycol and a propoxy polyalkylene glycol and combinations of two or more thereof. Still more preferably, the alkoxy polyalkylene glycol is a methoxy polyalkylene glycol.

Preferably, the polyalkylene glycol of the alkoxy polyalkylene glycol is selected from the group consisting of a polyethylene glycol, a polypropylene glycol, a polybutylene glycol, and combinations of two or more thereof. More preferably, the polyalkylene glycol of the alkoxy polyalkylene glycol is a polyethylene glycol. Most preferably, the polyalkylene glycol is methoxy polyethylene glycol.

Preferably, the polyalkylene glycol of the alkoxy polyalkylene glycol is a homopolymeric polyalkylene glycol. The polyalkylene glycol of the alkoxypolyalkylene glycol may, however, be a copolymer of an alkylene glycol and one or more further monomer units. The polyalkylene glycol may, for example, be a copolymer of two alkylene glycols, for example ethylene glycol and propylene glycol. The copolymers of the present invention may be block copolymers or random copolymers.

Preferably, the granulate and the coating material are present in a weight ratio of from 20:1 to 200:1, more preferably from 50:1 to 150:1, still more preferably from 80:1 to 120:1.

According to a second aspect, the present invention provides a method of preparing a granulate for a detergent composition, the method comprising:

(i) providing particles comprising a nitrogen-containing builder; and (ii) at least partially coating the particles with a coating material comprising an alkoxy polyalkylene glycol.

Preferably, the granulate is the granulate of the first aspect.

The particles may be in the form of a powder. In this embodiment, the method preferably further comprises (iii) compacting and/or drying the coated particles to form the granulate. The powder is preferably a spray-dried powder. That is, the powder is preferably prepared by spray-drying an aqueous solution or suspension comprising the nitrogen-containing builder.

Alternatively, the particles may be in the form of a granulate. The granulate is preferably prepared by compacting a powder, preferably a spray-dried powder.

Preferably, the step of at least partially coating the particles with a coating material comprising an alkoxy polyalkylene glycol comprises spray-coating the particles with an alkoxy polyalkylene glycol in liquid form. This allows for the coating of the particles while requiring minimal modification of existing manufacturing processes for detergent compositions.

The method may further comprise (iii) drying the coated particles or granulate. Suitable drying techniques are known in the art. For example, the coated particles or granulate can be dried in an oven at a temperature of from 40 to 60° C. for from 0.5 to 2 hours.

According to a third aspect, the present invention provides a granulate obtainable or obtained by the method of the second aspect.

According to a fourth aspect, the present invention provides a detergent composition comprising the granulate of the first or third aspects. Preferably, the detergent composition is an automatic dishwashing composition or a laundry detergent composition. Preferably, the nitrogen-containing builder is present in the composition in an amount of from 5 to 50 wt % by weight of the composition. Preferably, the alkoxy polyalkylene glycol is present in the composition in an amount of from 0.05 to 0.5 wt % by weight of the composition.

Preferably, the composition further comprises a bleaching agent. As explained above, the coating material of the present invention enhances the stability of the nitrogen-containing builder in the presence of oxidising agents, which tend to degrade certain nitrogen-containing builders and thereby contribute to the aforementioned discolouration.

The bleaching agent is preferably selected from the group consisting of an oxygen-releasing bleaching agent, a chlorine-releasing bleaching agent and combinations of two or more thereof. The bleaching agent may comprise the active bleach species itself or a precursor to that species. Preferably, the bleaching agent is selected from the group consisting of an inorganic peroxide, an organic peracid, hydrogen peroxide, and combinations of two or more thereof. The terms "inorganic peroxide" and "organic peracid" encompass salts and derivatives thereof. Inorganic peroxides include percarbonates, perborates, persulphates, hydrogen peroxide and derivatives and salts thereof. The sodium and potassium salts of these inorganic peroxides are suitable, especially the sodium salts. Most preferably, the bleaching agent is selected from the group consisting of sodium percarbonate, C-phthalimido-peroxy-hexanoic acid (PAP), peracetic acid, potassium peroxymonosulfate (KMPS), and combinations of two or more thereof. Sodium percarbonate is most preferred.

Preferably, the bleaching agent is present in an amount of from 1 to 50 wt % by weight of the composition, more preferably from 2 to 30 wt %, and most preferably from 5 to 25 wt %.

Preferably, the nitrogen-containing builder and the oxidising agent are present in a weight ratio of from 10:1 to 1:10, more preferably from 5:1 to 1:5, still more preferably from 3:1 to 1:3, and most preferably from 2:1 to 1:2.

The detergent composition may further comprise one or more bleach activators or bleach catalysts. Any suitable bleach activator may be included, for example TAED, if this is desired for the activation of the bleaching agent. Any suitable bleach catalyst may be used, for example manganese-based bleach catalysts and cobalt-based bleach catalysts. Exemplary manganese-based bleach catalysts include manganese acetate, manganese oxalate, or dinuclear manganese complexes such as those described in EP 1741774 A1, the contents of which are incorporated herein by reference. The organic peracids such as perbenzoic acid and peroxycarboxylic acids e.g. phthalimidoperoxyhexanoic acid (PAP) do not require the use of a bleach activator or catalyst as these bleaches are active at relatively low temperatures such as about 30° C.

The detergent composition may further comprise a co-builder. Preferred co-builders include homopolymers and copolymers of polycarboxylic acids and their partially or completely neutralized salts, monomeric polycarboxylic acids and hydroxycarboxylic acids and their salts, phosphates and phosphonates, and combinations of such substances. Preferred salts of the abovementioned compounds are the ammonium and/or alkali metal salts, i.e. the lithium, sodium, and potassium salts, and particularly preferred salts is the sodium salts. Co-builders which are organic are preferred. An example of a polymeric polycarboxylic acid is the homopolymer of acrylic acid. Other suitable co-builders are disclosed in WO 95/01416, which is incorporated herein by reference. Most preferably, the co-builder is trisodium citrate and/or hydroxyethylidene diphosphonate (HEDP).

The detergent composition may further comprise one or more ingredients that are conventionally included in detergent compositions. For example, the detergent composition may include one or more of the following: corrosion inhibitors, fragrances, surfactants, binding agents, acidity modifying agents, dispersion aids, enzymes and preservatives. Such ingredients are well-known to those skilled in the art. Preferably, the detergent composition comprises one or more surfactants, and/or one or more enzymes.

Preferably, the detergent composition is in the form of a solid. The solid may, for example, be in the form of a tablet, powder or granules. Preferably, the solid is a white solid. The yellow discolouration that typically occurs to certain nitrogen-containing builders in detergent compositions is most visible when the composition is white. Accordingly, the enhanced builder stability provided by the present invention is most clearly observed when the detergent composition is a white solid. The detergent composition may include a dye, for example in an amount of up to 0.01 wt %. Preferably, however, the detergent composition is free or essentially free of dye. The enhanced builder stability provided by the present invention means that there is no need to include a dye to mask the discolouration. This is advantageous because many dyes are known to deteriorate in the presence of oxidising agents.

Preferably, the detergent composition is storage stable for at least 12 weeks at 40° C. and 75% relative humidity. By "storage stable" it is meant that there is no perceptible discolouration of the nitrogen-containing builder over this timescale. The storage stability is preferably measured by filling a PVOH pouch with the detergent composition, sealing the pouch, and storing the sealed pouch in a sealed doy pack in a climate chamber under the aforementioned conditions.

In an especially preferred embodiment, there is provided a solid automatic dishwashing composition comprising a granulate, the granulate comprising an aminocarboxylate builder, wherein the aminocarboxylate builder comprises MGDA, wherein the granulate is at least partially coated with a coating material comprising an alkoxy polyalkylene glycol, wherein the alkoxy group of the alkoxypolyalkylene glycol is represented by the formula RO wherein R is a $C_1$ to $C_{10}$ alkyl group, wherein the polyalkylene glycol of the alkoxy polyalkylene glycol is selected from the group consisting of a polyethylene glycol, a polypropylene glycol, a polybutylene glycol, and combinations of two or more thereof, wherein the composition further comprises a bleaching agent selected from the group consisting of sodium percarbonate, C-phthalimido-peroxy-hexanoic acid (PAP), peracetic acid, potassium peroxymonosulfate (KMPS), and combinations of two or more thereof.

According to a fifth aspect, the present invention provides a detergent product comprising the composition of the fourth aspect. Preferably, the detergent product is an automatic dishwashing product or a laundry detergent product.

The detergent product may comprise a plurality of compositions. For example, the product may comprise a composition in accordance with the fourth aspect in the form of a solid and at least one further composition in the form of a solid, liquid, gel or paste. Each composition may include any of the components listed in relation to the fourth aspect.

Preferably, the product is in a unit dose or monodose form. In other words, the product comprises one or more compositions in the quantity required for a single wash cycle of a machine dishwasher or a laundry washing machine. The terms monodose and unit dose are used interchangeably throughout this disclosure.

In an embodiment, the detergent product is housed within a water soluble film or container, preferably a polyvinylalcohol (PVOH) film or container. The film or container may be prepared for example by injection moulding or thermoforming. The film or container may be a rigid capsule or film blister. The capsule or blister may have a single compartment or may be multi-compartment. Multi-compartment blisters or capsules may have different portions of the product in each compartment, or the same composition in each compartment. The distinct regions/compartments may contain any proportion of the total amount of ingredients as desired. The capsules or film blisters may be filled with tablets, powders, gels, pastes or liquids, or combinations of these, within the scope of the invention.

The film or container may be an injection moulded or thermoformed water soluble capsule with multiple compartments. Each compartment may comprise a different composition. Each compartment may be filled with a tablet, a powder, granules, a liquid, a gel, a paste, or combinations of two or more thereof.

In an especially preferred embodiment, there is provided an automatic dishwashing product comprising:

(i) a solid automatic dishwashing composition comprising a granulate, the granulate comprising an aminocarboxylate builder, wherein the aminocarboxylate builder comprises MGDA, wherein the granulate is at least partially coated with a coating material comprising an alkoxy polyalkylene glycol, wherein the alkoxy group of the alkoxypolyalkylene glycol is represented by the formula RO wherein R is a $C_1$ to $C_{10}$ alkyl group, wherein the polyalkylene glycol of the alkoxy polyalkylene glycol is selected from the group consisting of a polyethylene glycol, a polypropylene glycol, a polybutylene glycol, and combinations of two or more thereof, wherein the composition further comprises a bleaching agent selected from the group consisting of sodium percarbonate, C-phthalimido-peroxy-hexanoic acid (PAP), peracetic acid, potassium peroxymonosulfate (KMPS), and combinations of two or more thereof; and (ii) one or more automatic dishwashing compositions in the form of a liquid or gel;

wherein the solid composition and the one or more liquid or gel compositions are housed within individual compartments of a polyvinyl alcohol film or container.

According to a sixth aspect, the present invention provides the use of the detergent composition of the fourth aspect or the detergent product of the fifth aspect in an automatic dishwashing process or a laundry process.

According to a seventh aspect, the present invention provides the use of a coating material comprising an alkoxy polyalkylene glycol to reduce the yellowing of a nitrogen-containing builder in a detergent composition.

Preferably, the detergent composition is the detergent composition of the fourth aspect.

All percentages used in this disclosure are by weight unless otherwise specified.

The present invention will now be described in relation to the following non-limiting example.

EXAMPLE 1

A three-compartment PVOH pouch was filled with a powder automatic dishwashing (ADW) composition, a liquid ADW composition and a gel ADW composition. The resulting product (Product A, not in accordance with the invention) contained an uncoated granulate of MGDA and disilicate containing at least 70 wt % of the aminocarboxylate, from 2 to 10 wt % of the disilicate and less than 20 wt % of water. The granulate was supplied by PQ Corporation, and was blended into the base powder composition. A second product was also made (Product B, in accordance with the invention), in which the uncoated granulate of Product A was replaced with the same granulate coated with a liquid methoxy polyethylene glycol (MPEG 350 NG, supplied by Ineos).

The powder composition of Product A was as follows:

| Component | Amount (wt %) |
|---|---|
| MGDA/disilicate granulate | 32.5 |
| Sodium percarbonate coated | 22.0 |
| Sodium carbonate | 18.7 |
| Phosphonate cobuilder | 9.5 |
| Enzymes | 8.6 |
| Polymers/surfactants | 8.2 |
| Fragrance | 0.5 |
| Total | 100.0 wt % |

The liquid phase of Product A contained a surfactant and a dye.

The gel phase of Product A contained a co-builder, a bleach activator, a corrosion inhibitor, and further surfactants/polymers.

Product B was identical to Product A, except the 32.5 wt % uncoated MGDA/disilicate granulate in the powder was replaced with 32.5 wt % coated MGDA/disilicate granulate in accordance with the invention.

Preparation of Coated Granulate

To apply the methoxy polyethylene glycol, the uncoated granulate was placed in a kitchen mixing machine and 1 wt % of a liquid MPEG (MPEG 350 NG) was sprayed on using a pumping atomizer bottle while mixing. This mixture was then placed in an oven and dried at 50° C. for approximately 1 hour. The dried, coated granulate was then blended into the base powder formulation in the same manner as for Product A.

Product Storage

After the PVOH pouches were filled and sealed, Product A and Product B were placed into doy packs and stored in a controlled climate chamber at 40° C. and 75% relative humidity (r.h.). Visual comparisons of Product A and Product B were conducted at regular time intervals.

Product Analysis

In order to evaluate the yellowing of samples, a panel of evaluators was selected and a triangle test was conducted.

Set-up: For the triangle test a panel of 24 independent assessors was selected and each assessor was presented with one of the six sample sequences ABB, AAB, ABA, BAA, BBA, BAB simultaneously. Next the assessors were informed that two of the samples are the same and that one is different. Each panellist should then indicate which of the three samples is different from the other two. Additionally, each panellist was then asked to indicate whether the selected sample was looking better or worse than the other two identical samples.

Results after 6 weeks' storage at 40° C./75% r.h.: Of the 24 assessors, 17 correctly identified the unique sample within each triad. This is sufficient to establish at a <0.05 risk level that the two sample types are perceptibly different. Moreover, all 17 correct answers were able to indicate if the selected odd sample was looking better or worse than the two other identical samples. Accordingly, it was found that the powder component of Product A was perceptibly more yellow than the powder component of Product B.

Results after 12 weeks' storage at 40° C./75% r.h.: Of the 24 assessors, 15 correctly identified the unique sample within each triad. This is sufficient to establish at a <0.05 risk level that the two sample types are perceptibly different. Moreover, all 15 correct answers were able to indicate if the selected odd sample was looking better or worse than the two other identical samples. Accordingly, it was found that the powder component of Product A was perceptibly more yellow than the powder component of Product B.

Taking these results together provides strong evidence that a difference between the benchmark (base powder+uncoated MGDA/disilicate granulate) and the inventive composition (base powder+MGDA/disilicate granulate coated with 1 wt % MPEG 350NG) was apparent after storage for 6 weeks and 12 weeks at 40° C. and 75% r.h.

In conclusion, coating a granulate comprising an nitrogen-containing builder with an alkoxy polyalkylene glycol was found to significantly reduce the yellowing of the nitrogen-containing builder in the presence of a bleaching agent (sodium percarbonate) at elevated temperatures and moisture levels over prolonged storage periods.

The foregoing detailed description has been provided by way of explanation and illustration, and is not intended to limit the scope of the appended claims. Many variations in the presently preferred embodiments illustrated herein will be apparent to one of ordinary skill in the art, and remain within the scope of the appended claims and their equivalents.

The invention claimed is:

1. A granulate for a detergent composition, the granulate comprising a nitrogen-containing builder, wherein the granulate is at least partially coated with a coating material comprising an alkoxy polyalkylene glycol, wherein the alkoxy polyalkylene glycol has a weight average molecular weight of from 200 to 500 g/mol, and wherein the alkoxy polyalkylene glycol is a liquid at 25° C.

2. The granulate according to claim 1, wherein the alkoxy group of the alkoxy polyalkylene glycol is represented by the formula RO wherein R is a C1 to C20 alkyl group.

3. The granulate according to claim 1, wherein the polyalkylene glycol of the alkoxy polyalkylene glycol is selected from the group consisting of a polyethylene glycol, a polypropylene glycol, a polybutylene glycol, and combinations of two or more thereof.

4. The granulate according to claim 1, wherein the alkoxy polyalkylene glycol is a methoxy polyethylene glycol.

5. The granulate according to claim 1, wherein the nitrogen-containing builder comprises an aminocarboxylate.

6. The granulate according to claim 1, wherein the granulate and the coating material are present in a weight ratio of from 20:1 to 200:1.

7. A method of preparing the granulate for a detergent composition according to claim 1, the method comprising:

(i) providing particles comprising the nitrogen-containing builder; and (ii) at least partially coating the particles with a coating material comprising the alkoxy polyalkylene glycol.

8. The method according to claim 7, wherein the step of at least partially coating the particles with the coating material comprising the alkoxy polyalkylene glycol comprises spray-coating the particles with the alkoxy polyalkylene glycol.

9. A detergent composition comprising the granulate according to claim 1.

10. The detergent composition according to claim 9, wherein the detergent composition is an automatic dishwashing composition or a laundry detergent composition.

11. The detergent composition according to claim 9, wherein the composition further comprises a bleaching agent.

12. The detergent composition according to claim 9, wherein the detergent composition is in the form of a solid.

13. The detergent composition according to claim 9, wherein the nitrogen-containing builder is present in an amount of from 5 to 50 wt % by weight of the detergent composition, and/or the detergent composition comprises a bleaching agent in an amount of from 1 to 50 wt % by weight of the detergent composition.

14. The detergent composition according to claim 9, wherein the composition is storage stable for at least 12 weeks at 40° C. and 75% relative humidity.

15. A detergent product comprising the detergent composition according to claim 11.

16. The detergent product according to claim 15, wherein the product is:

in a unit dose form; and/or housed within a water soluble or water dispersible film or container.

17. The detergent product according to claim 16, wherein the product is housed within a polyvinyl alcohol film or container.

* * * * *